US005471962A

United States Patent [19]

Nakashima et al.

[11] Patent Number: 5,471,962

[45] **Date of Patent: * Dec. 5, 1995**

[54] FUEL SUPPLY SYSTEM FOR INTERNAL COMBUSTION ENGINES

[75] Inventors: Kazushi Nakashima; Shinichi Iwamoto, both of Obu, Japan

[73] Assignee: Nippondenso Co., Ltd., Kariya, Japan

[ * ] Notice: The portion of the term of this patent subsequent to Nov. 1, 2011, has been disclaimed.

[21] Appl. No.: 237,880

[22] Filed: May 4, 1994

Related U.S. Application Data

[63] Continuation-in-part of Ser. No. 135,984, Oct. 14, 1993, Pat. No. 5,359,976, and a continuation-in-part of Ser. No. 170, 923, Dec. 21, 1993.

[30] Foreign Application Priority Data

Oct. 15, 1992 [JP] Japan ..... 4-277095

[51] Int. Cl.[6] ..... F02M 37/04

[52] U.S. Cl. ..... 123/456; 123/516

[58] Field of Search ..... 123/456, 516, 123/470, 472, 471, 468, 469

[56] References Cited

U.S. PATENT DOCUMENTS

| | | | |
|---|---|---|---|
| 4,294,215 | 10/1981 | Hans et al. . | |
| 4,503,832 | 3/1985 | Pefley et al. . | |
| 4,539,961 | 9/1985 | Atkins et al. . | |
| 4,556,034 | 12/1985 | Anklam et al. . | |
| 4,601,275 | 7/1986 | Weinand . | |
| 4,876,993 | 10/1989 | Slattery . | |
| 4,955,409 | 9/1990 | Tokudat et al. . | |
| 4,966,120 | 10/1990 | Itoh et al. . | |
| 4,984,548 | 1/1991 | Hudson, Jr. . | |
| 5,044,344 | 9/1991 | Tuckey et al. . | |
| 5,078,167 | 1/1992 | Brandt et al. . | |
| 5,095,876 | 3/1992 | Yonekawa et al. . | |
| 5,275,145 | 1/1994 | Tuckey . | |
| 5,359,976 | 11/1994 | Nakashima | 123/456 |

FOREIGN PATENT DOCUMENTS

| | | |
|---|---|---|
| 512235 | 11/1992 | European Pat. Off. . |
| 62-137379 | 8/1987 | Japan . |

*Primary Examiner*—Carl S. Miller

*Attorney, Agent, or Firm*—Cushman, Darby & Cushman

[57] ABSTRACT

In a fuel supply system for internal combustion engines, a fuel delivery pipe to which fuel injectors are mounted through respective connectors is connected to a fuel tank through a fuel connecting pipe without return piping. At least one of the connectors of the injectors is extended upwardly to open at an upper portion in the delivery pipe and has a small diameter extension pipe for enhancing sucking in air or vapor in the fuel delivery pipe into the injectors. A fuel pipe which is branched off from the fuel connecting pipe is provided above the delivery pipe, and the fuel pipe and the delivery pipe are connected with each other by a connecting orifice. The connecting orifice also extends upwardly to open at an upper portion in the fuel pipe. In the event that air or fuel vapor is generated in the fuel supply system, it is accumulated in the fuel pipe, gradually introduced into the delivery pipe through the connecting orifice, and then rapidly purged with fuel through the extended connectors and the injectors when the injectors inject fuel into an engine.

12 Claims, 12 Drawing Sheets t1
t2
t3
t4
12
BATTERY
VOLTAGE
VB (Volt)
8
0

INITIAL EXPL.
FLAG (XEXP)
1
0

Nstart
ENGINE RPM
Ne
0

TPURG
START PULSE
TSTA
0
TIME

FUEL SUPPLY SYSTEM FOR INTERNAL COMBUSTION ENGINES

This application is a continuation-in-part of both application Ser. Nos. 08/135,984, now U.S. Pat. No. 5,359,976, and 08/170,923, still pending, respectively filed Oct. 14, 1993 and Dec. 21, 1993.

BACKGROUND OF THE INVENTION

The present invention relates to a fuel supply system for internal combustion engines, including a fuel delivery pipe.

In a conventional fuel supply system for internal combustion engines in which fuel injectors are supplied with fuel from a delivery pipe, air is mixed with fuel in the fuel delivery pipe for some reason or fuel vapor is generated under a high temperature condition. Such air or fuel vapor is purged to a return piping through a pressure regulator when a fuel pump is in operation. For example, a Japanese Utility Model Laid-open No. 62-137379 discloses a fuel supply system, wherein a fuel pipe connected to the fuel delivery pipe is provided thereabove and is connected to the pressure regulator so that the air or vapor is purged to the return piping without being accumulated in the fuel delivery pipe.

It is desired to eliminate the return piping in order to simplify the fuel supply system. However, if the return piping is eliminated, there is no way for air or vapor in the fuel delivery pipe to be purged and it is accumulated in the fuel delivery pipe, resulting in a decrease in the amount of fuel to be injected.

SUMMARY OF THE INVENTION

It is therefore an object of the present invention to prevent the decrease of fuel amount to be injected by effectively purging air or fuel vapor accumulated in a fuel delivery pipe without having return piping.

According to the present invention, at least one of connectors for supplying fuel to injectors connected to a fuel delivery pipe is extended to an upper portion of a delivery pipe and sucking ports of the connectors are opened at the upper portion of the inside of the fuel delivery pipe. Preferably, a fuel pipe is branched off from a fuel connecting pipe located upstream of the fuel delivery pipe and is mounted above the fuel delivery pipe. The fuel pipe and the fuel delivery pipe are connected to each other by a connecting orifice.

The fuel delivery pipe can purge the air or vapor, which has accumulated in the fuel delivery pipe before an engine starts, through at least one of the injectors during the engine cranking period. As to the small amount of air mixed with the fuel during engine operation, it can be broken down into small size at the connecting orifice and accumulated in the fuel pipe so that it may be purged from the injectors.

DETAILED DESCRIPTION OF THE PREFERRED EMBODIMENTS

Figure 6:
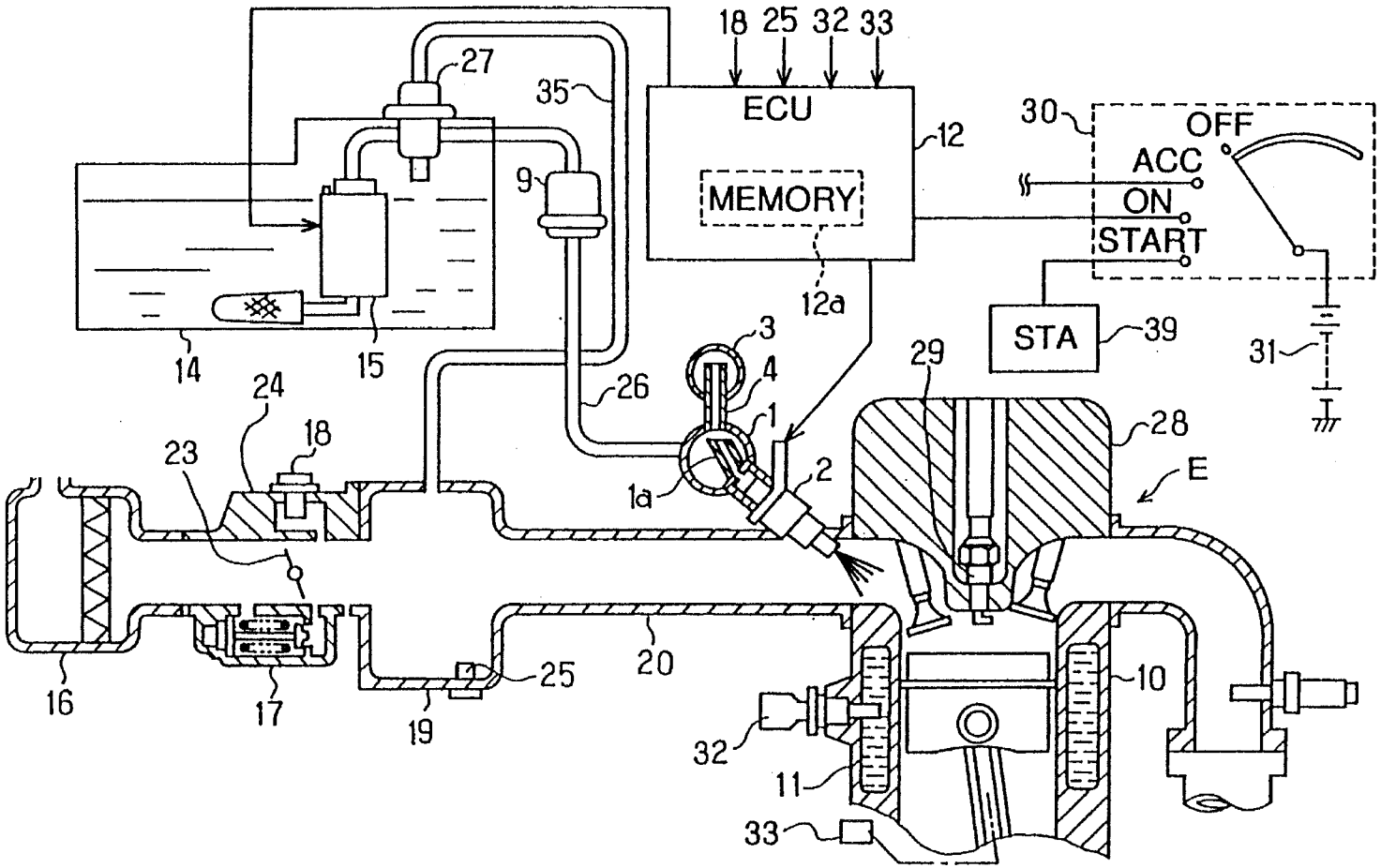
FIG. 6 is a schematic view of a fuel injection control system to which the above embodiments are applied.

First, reference is made to FIG. 6 showing a fuel injection control system in which a fuel supply system of the present invention is applied. In a multi-cylinder engine E, an intake pipe 20 is attached to an engine body 10. At an upstream portion of the intake pipe 20, a throttle body 24, in which a throttle valve 23 operated by an acceleration pedal not shown in FIG. 6 is installed, is connected thereto. Downstream of the throttle valve 23, there is installed a surge tank 19 having an intake air temperature sensor 25 therein. An idle speed control valve 17 for controlling by-pass air and an intake air pressure sensor 18 are attached to the throttle body 24. At the end of the downstream portion of the intake pipe 20, an injector 2 for injecting fuel to each cylinder of the engine E is mounted. An air cleaner 16 is installed upstream of the throttle body 24. A spark plug 29 is mounted on a cylinder head 28 of each cylinder of the engine E. A sensor 32 for detecting the temperature of cooling water circulating in the engine body 10 is installed in a cylinder block 11. A rotational angular sensor 33 is provided for generating a signal at each predetermined rotational angle of a crankshaft of the engine E not shown in the drawing.

A starter motor 39 for cranking the engine E is connected to a battery 31 through a key switch 30. The starter motor 39 is driven by the battery 31 through operation of the key switch 30. The key switch having four positions, "OFF", "ACC", "ON" and " START" is operated by a key not shown in the Figures. As the key switch 30 is turned from the "OFF" position to the "ACC" position, electric power is supplied to head lights and a radio, etc. As the key switch 30 is turned to the "ON" portion, electric power is supplied to an electronic control unit which will be explained later from the battery 31. At the "START" position, the electric power is supplied to the starter motor 39.

An electronic control unit (hereinafter referred to as ECU) 12 is operated by electric power supplied from the battery 31. Information such as intake air temperature TA, intake pressure Pm, water temperature Tw and engine speed Ne are fed to the ECU from the intake air temperature sensor 25, the intake air pressure sensor 18, the water temperature sensor 32 and the rotational angular sensor 33, respectively. The ECU 12 generates output signals for driving the injectors 2 and a fuel pump 15 according to the aforementioned input information. In the ECU 12, a memory 12*a* is provided for temporarily storing signals from the various sensors and results of calculation.

In the fuel supply system, the fuel pump 15 for pumping fuel is installed in a fuel tank 14. A fuel connecting pipe 26 connects the fuel pump 15 and a fuel delivery pipe 1 through a fuel pressure regulator 27 and a fuel filter 9. The fuel delivery pipe 1 is connected to a fuel pipe 3 by a connector 4 and connected to each injector through a connector 4. The delivery pipe 1 temporarily stores fuel therein and distributes fuel to the injectors 2. Intake negative pressure is introduced to the fuel pressure regulator 27 through a negative pressure pipe 35. Thus the fuel pressure in the fuel delivery pipe 1 is maintained at a predetermined value by the fuel pressure regulator 27. The pressure regulator 27 may be installed within the fuel tank 14 and, instead of the intake negative pressure, atmospheric pressure or fuel tank inner pressure may be introduced to the pressure regulator 27. It is to be noted that the fuel supply system in FIG. 6 has no fuel return piping and the fuel pressure regulator 27 is provided between the fuel pump 15 and the fuel delivery pipe 1.

The above-described fuel supply system will be explained in more detail with reference to preferred embodiments shown in FIGS. 1 through 5. In a first embodiment shown in FIGS. 1 and 2, all the connectors 1*a* of the fuel injectors 2 are extended into an upper portion in the fuel delivery pipe 1, and the fuel sucking ports of the connectors 1*a* which supply fuel to the injectors 2 are opened at the upper portion of the fuel delivery pipe 1. The fuel pipe 3 is branched off at the upstream portion of the fuel delivery pipe 1 through a branch intersection 5 connected to a fuel connecting pipe 6 which is designated by a reference numeral 26 in FIG. 6. The fuel pipe 3 is mounted above the fuel delivery pipe 1 and in parallel therewith. The closed end portion of the fuel pipe 3 and the closed end portion of the fuel delivery pipe 1 are connected with each other by means of a pipe-shaped connecting orifice 4. The connecting orifice 4 is extended into the fuel pipe 3 and opened at an upper portion in the back-end of the fuel pipe 3.

Figure 2:
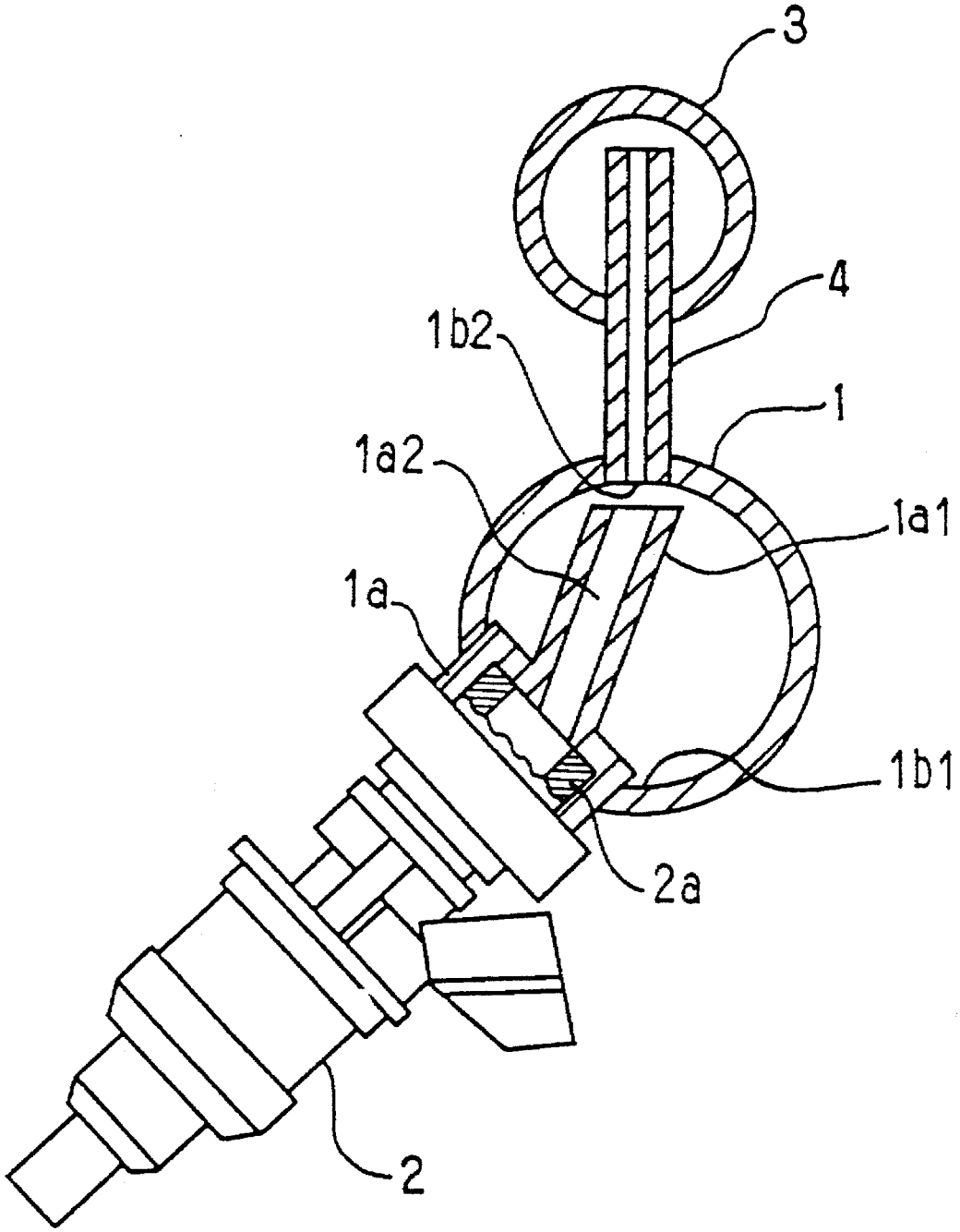
FIG. 2 is a side cross-sectional view of a first embodiment of the present invention shown in FIG. 1.

Here, as shown in FIG. 2, each connector 1*a* is arranged at a position circumferentially shifted from a lowermost portion 1*b*1 or slightly higher than the lowermost portion 1*b*1 of the fuel delivery pipe 1 such that the injector 2 may be connected at a lower portion of the delivery pipe 1 not in a vertical direction but in a slant direction (see also FIG. 6). Each connector 1*a* has an extension pipe 1*a*1 which extends upwardly in a slanting direction from the lower portion of the delivery pipe 1 to an uppermost portion 1*b*2. The extension pipe 1*a*1 has an outer diameter smaller than that of a suction port 2*a* of the injector 2 and has a restricted passage 1*a*2 which is smaller in inner diameter than a fuel passage or inner diameter of the suction port 2*a*. By this dimensional relationship between the fuel passages of the extension pipe 1*a*1 and the suction port 2*a*, flow speed in the passage 1*a*2 is increased and hence air or vapor in the upper portion of the delivery pipe is easily sucked into the passage 1*a*2 and the suction port 2*a*. Further, the sucking port or the top end of the extension pipe 1*a*1 is so shaped that the end surface does not cross an axis of the extension pipe 1*a*1 at a right angle. That is, the top end surface of the extension pipe 1*a*1 is kept in parallel relation with the fuel surface in the fuel delivery pipe 1 or it is kept horizontally in the vicinity of the uppermost portion 1*b*2 of the delivery pipe 1. Thus, air or vapor in the upper portion of the delivery pipe 1 is easily sucked into the extension pipe 1*a*1. This is very advantageous when the fuel is introduced first into the delivery pipe 1 and air remains at the upper portion of the delivery pipe 1.

The first embodiment operates in the following manner.

(1) Air mixed in the fuel connecting pipe 6 is separated by a floating force at the branch intersection 5 and delivered to the fuel pipe 3 to be stored therein. When the injectors 2 are operated to inject fuel intermittently into the engine, a pressure fluctuation occurs between the fuel in the delivery pipe 1 and in the fuel pipe 3. Because of this, the air is broken into small size, sucked into the fuel delivery pipe 1 through the connecting orifice 4 and then injected with fuel through the injectors 2. That is, the air in the fuel is purged by operation of the injectors 2. A decrease of the amount of injected fuel is negligible, because the air purged in one injection is very small and fuel pressure during operation of the injectors 2 is actually increased due to an expansion of the air stored in the fuel pipe 3. Thus, engine driveability is kept at the same level as normal operation when there is no air in the fuel pipe 3.

(2) Fuel vapor generated in the fuel delivery pipe 1 at high temperature is transferred to the fuel delivery pipe 3 through the branch intersection 5, because the vapor is lighter than fuel. The vapor is purged in the same way as the air mentioned above.

(3) In a particular case such as engine mounting at a factory, a large amount of air which can not be stored in the fuel pipe 3 may be mixed. In this case, the large amount of the air can be purged through the injectors 2 during engine cranking period, because all the connectors 1*a* are opened at the upper portion in the fuel delivery pipe 1 for sucking the air into the injectors 2 with ease.

Figure 3:
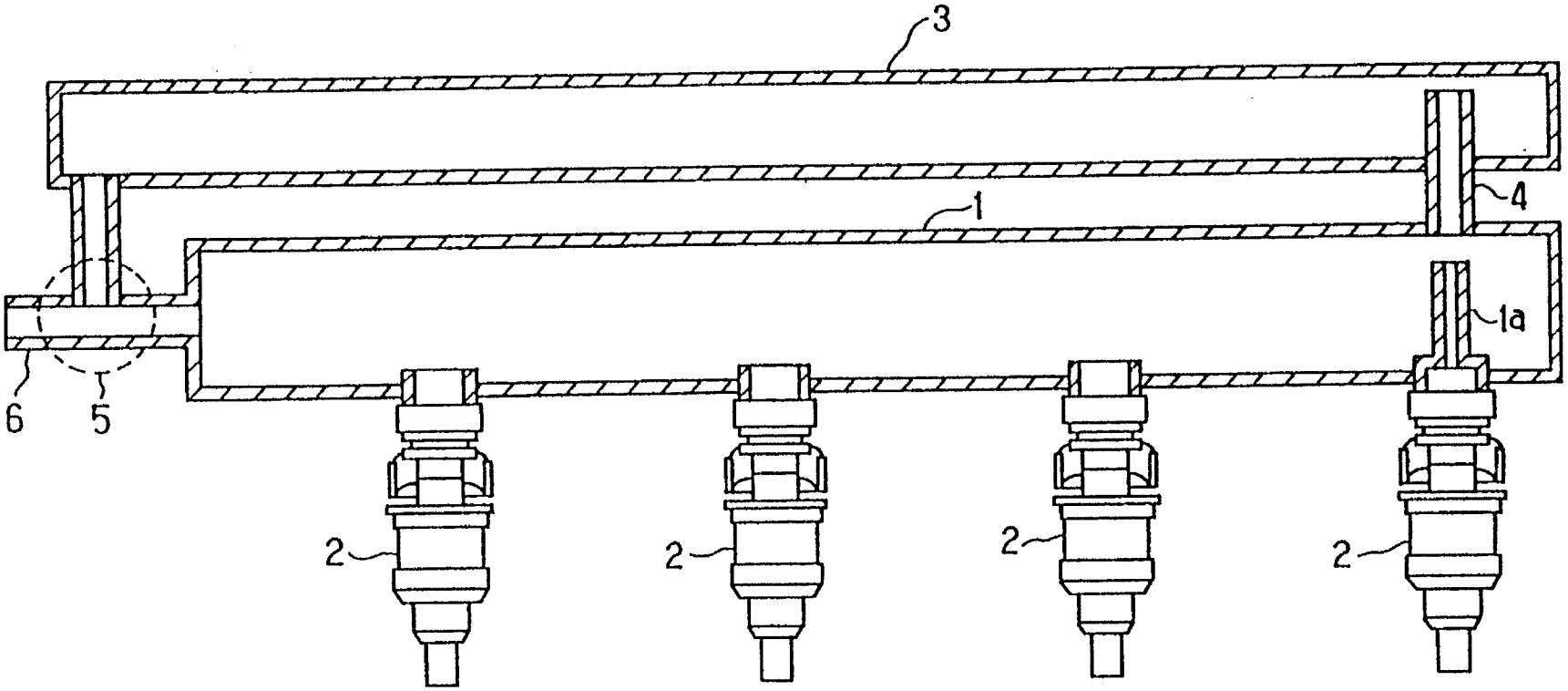
FIG. 3 is a front cross-sectional view of a second embodiment of the present invention.

In a second embodiment shown in FIG. 3, only one of the connectors 1*a*, i.e. the right-most connector in the Figure, which connects the fuel delivery pipe 1 with the injectors 2 is extended into the upper portion in the fuel delivery pipe 1 at the closed end portion thereof, and the sucking port of the extended connector 1*a* is opened at the upper portion in the fuel delivery pipe 1 while the sucking ports of the other connectors 1*a* are opened at the lower portion in the fuel delivery pipe 1.

The second embodiment operates in the same manner as the above-described first embodiment with regard to the purging of air (1) and fuel vapor (2). In a particular case such as engine mounting at a factory, a large amount of air which can not be stored in the fuel pipe 3 may be mixed. In this case the large amount of the air will be purged in the following process.

(3) When the amount of the air exceeds the amount that the fuel pipe 3 can store therein, the excessive air will be purged gradually through the right-most connector 1*a*. In this case, the engine may be operated only by the cylinders with injectors 2 which are not connected to the extended connector 1*a*. During this operation, the engine output may be degraded a little, but this does not cause any problem because this operation occurs only in the particular case as above mentioned.

Figure 4:
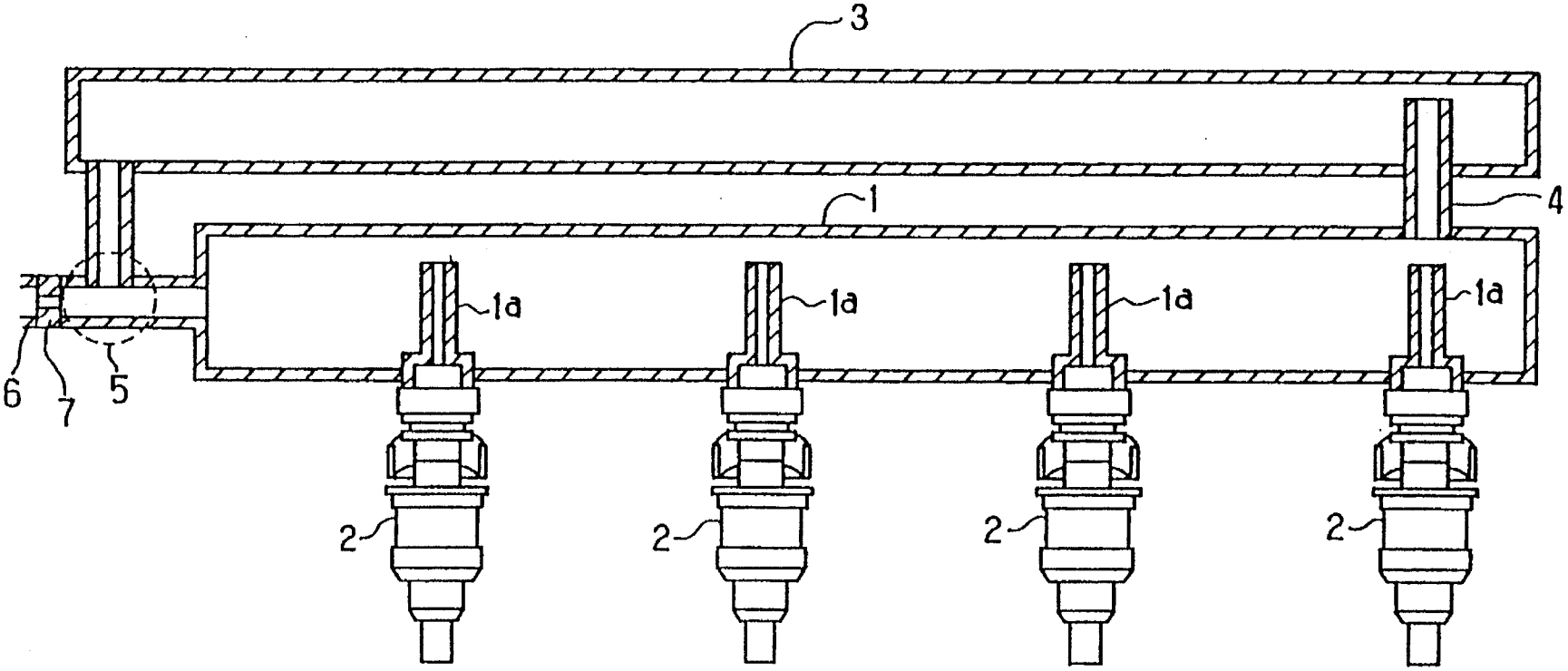
FIG. 4 is a front cross-sectional view of a third embodiment of the present invention.

In a third embodiment shown in FIG. 4, an orifice 7 is provided in the fuel connecting pipe 6 upstream of the branch intersection 5. All the connectors 1*a* of the injectors 2 are extended as in the above-described first embodiment.

According to this third embodiment, the air is better separated from fuel at the branch intersection 5 because the air mixed with fuel flowing through the fuel connecting pipe 6 is broken into a smaller size by means of the orifice 7.

Figure 1:
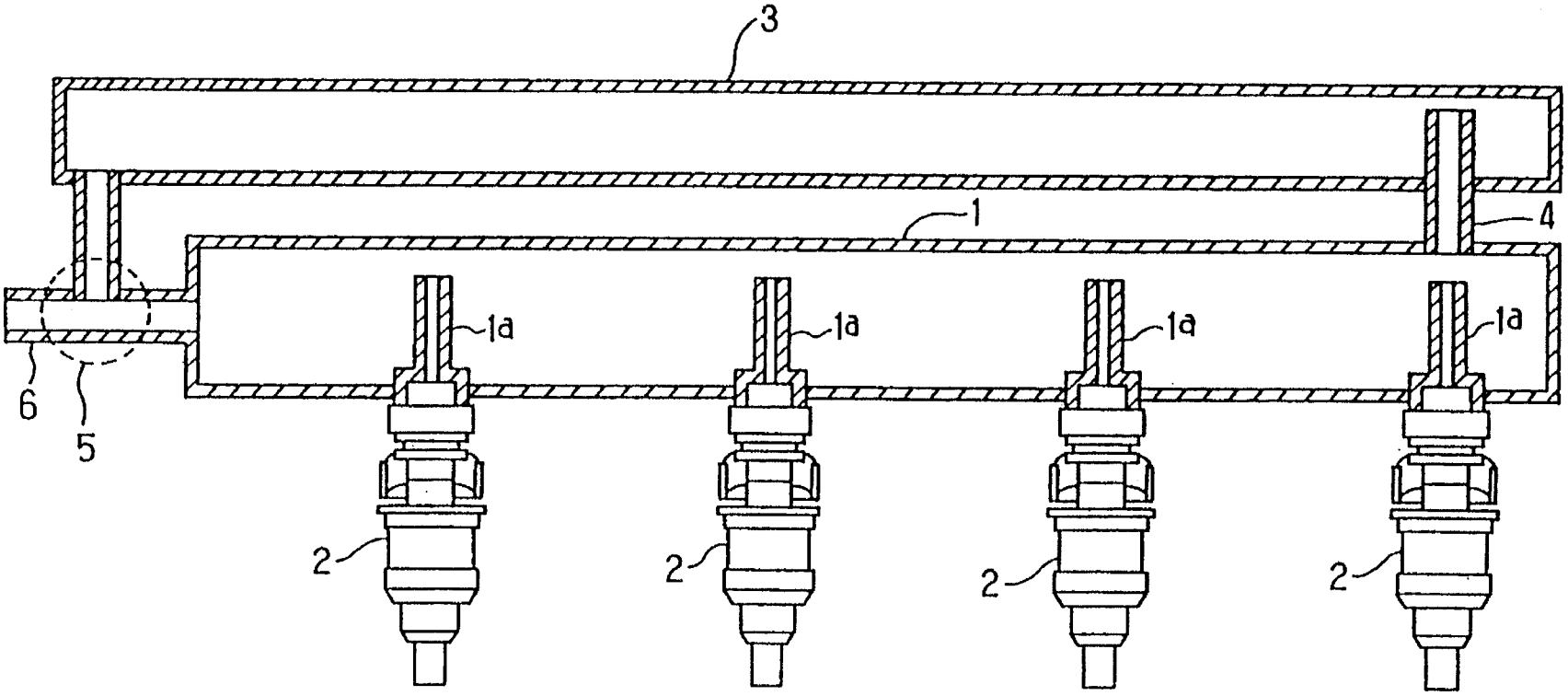
FIG. 1 is a front cross-sectional view of a first embodiment of the present invention.
Figure 5:
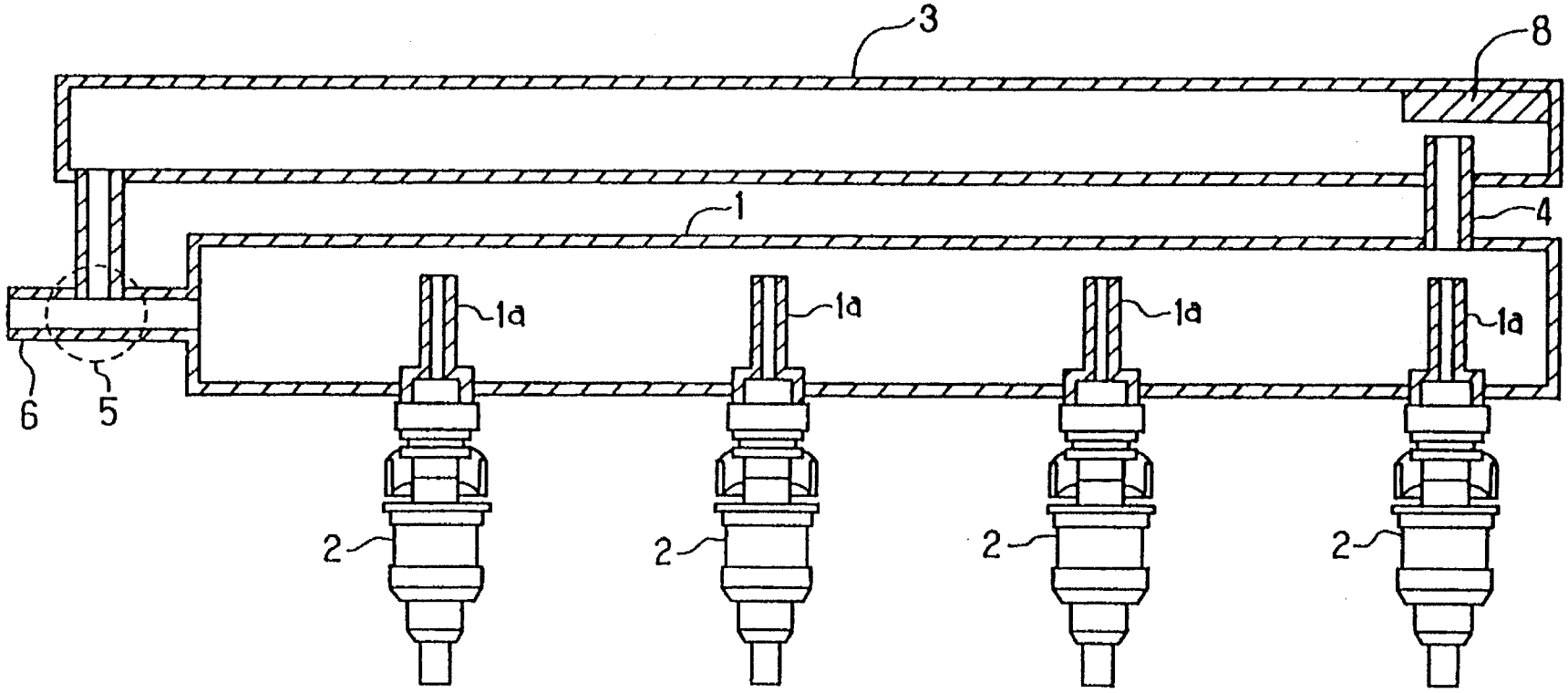
FIG. 5 is a front cross-sectional view of a fourth embodiment of the present invention.

In a fourth embodiment shown in FIG. 5, a spacer 8 is added to the first embodiment of FIGS. 1 and 2. The spacer 8 is provided in the fuel pipe 3, so that the cross sectional area of the fuel pipe 3 at the neighborhood above the connecting orifice 4 is made smaller than that of other portion, with a small gap left between the spacer 8 and the extended upper end of the connecting orifice 4.

According to this fourth embodiment, when the amount of air or fuel vapor contained in the fuel pipe 3 becomes less than the predetermined amount, the sucking port of the connecting orifice 4 does not come into contact with the air or fuel vapor. Thus a certain amount of the air or vapor remains in the fuel pipe 3. Because of an expansion of the remaining air or vapor in the fuel pipe 3, pressure fluctuation in the fuel connecting pipe 6, the fuel delivery pipe 1 and the fuel pipe 3 is controlled, resulting in a smaller pressure fluctuation in the whole fuel supply system.

Figure 8:
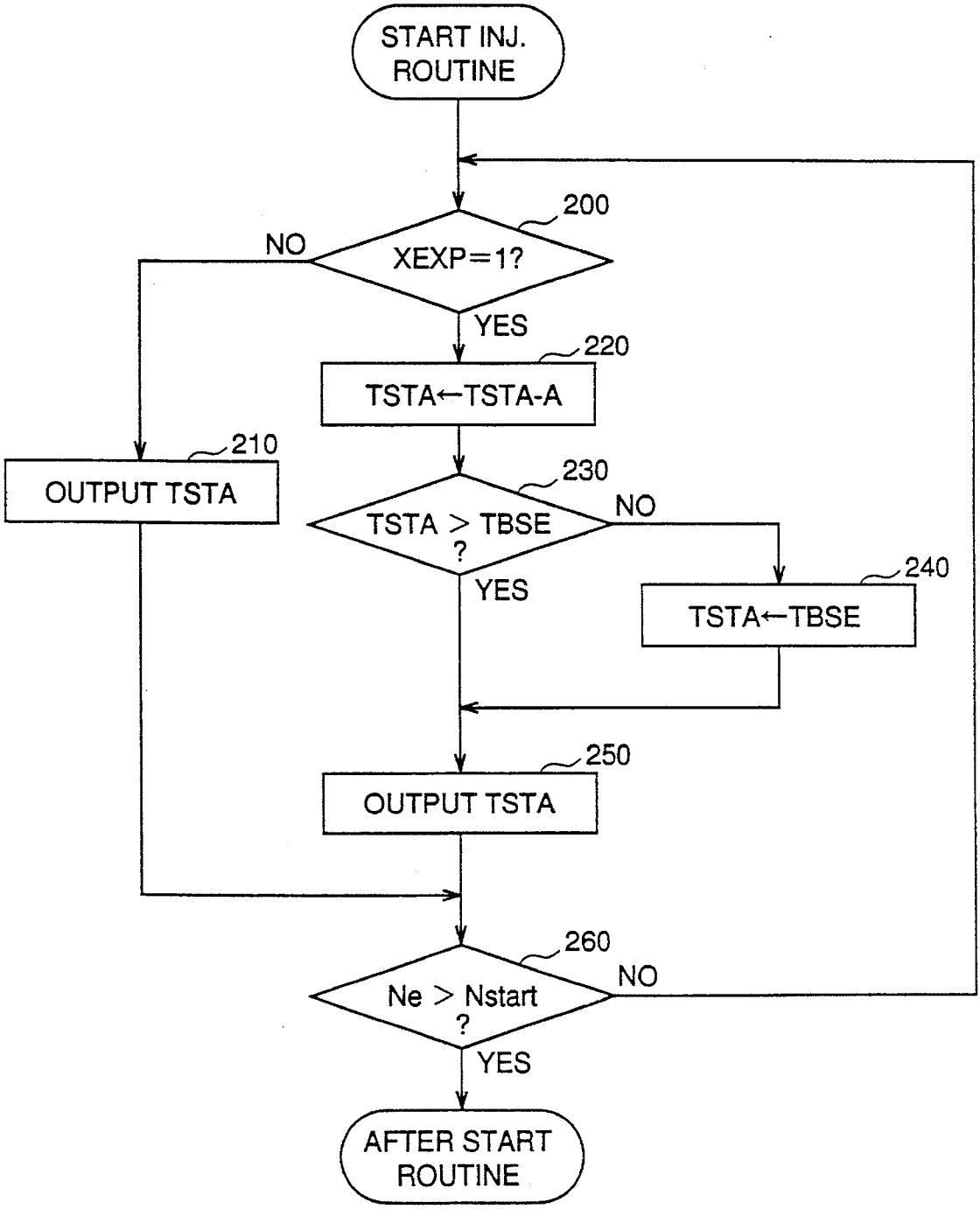
FIG. 8 is a flow chart showing a start injection routine performed by the ECU shown in FIG. 6.
Figure 9:
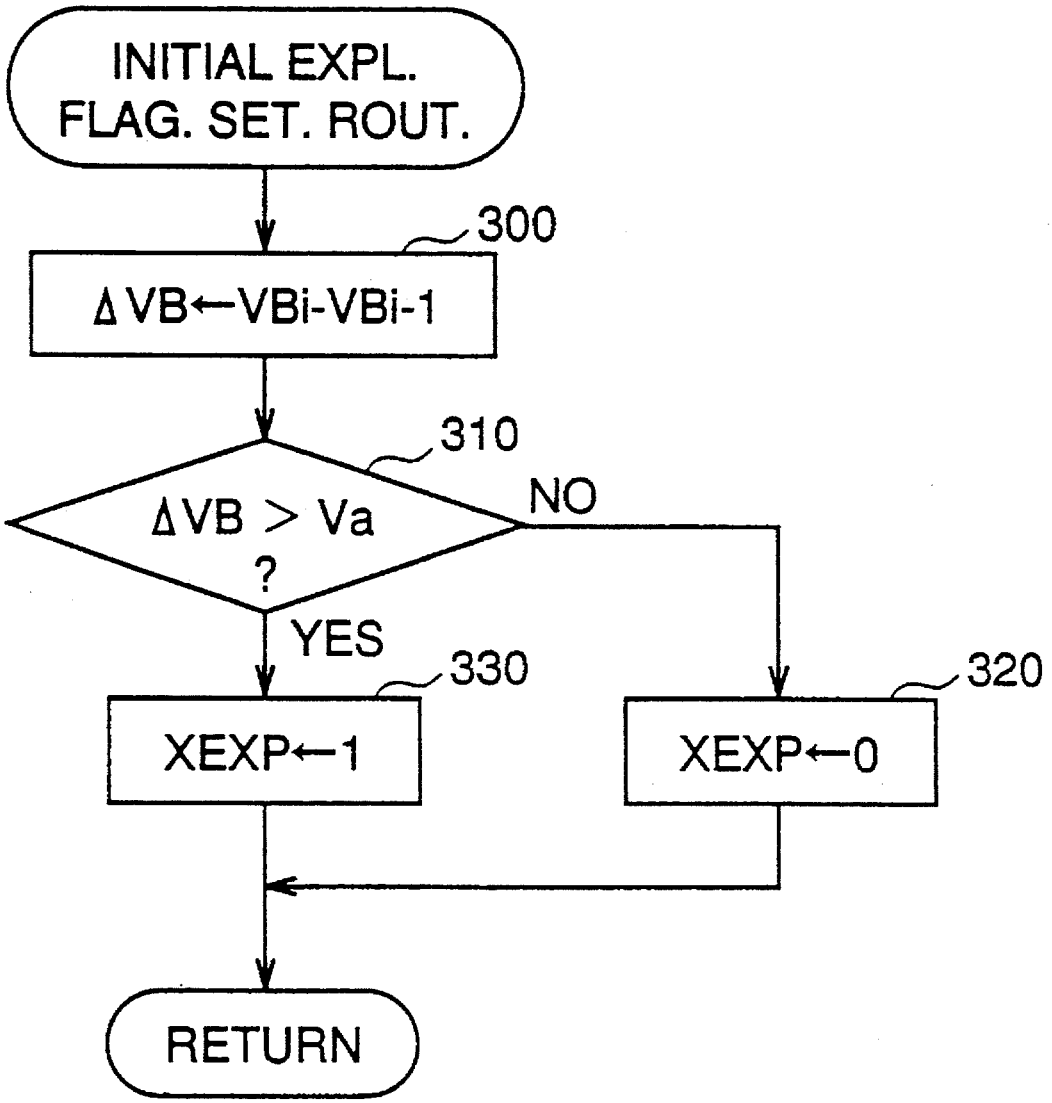
FIG. 9 is a flow chart showing an initial explosion flag setting routine performed by the ECU shown in FIG. 6.

Hereinafter, overall operation of the fuel injection control system shown in FIG. 6, particularly operation of the ECU 12, will be explained with reference to FIGS. 7 through 14. It is to be understood that an initial routine shown in FIG. 7 starts as the key switch 30 is turned to the "ON" position from the "OFF" position or "ACC" at a timing t1 shown in FIGS. 10A to 10D. When the key switch 30 is turned to the "START" position from the "ON" position at a timing t2, a start injection routine shown in FIG. 8 is put into operation. An initial explosion flag-setting routine shown in FIG. 9 is repeated at every predetermined crank angle, interrupting the start injection routine of FIG. 8.

Figures 10A, 10B, 10C, 10D:
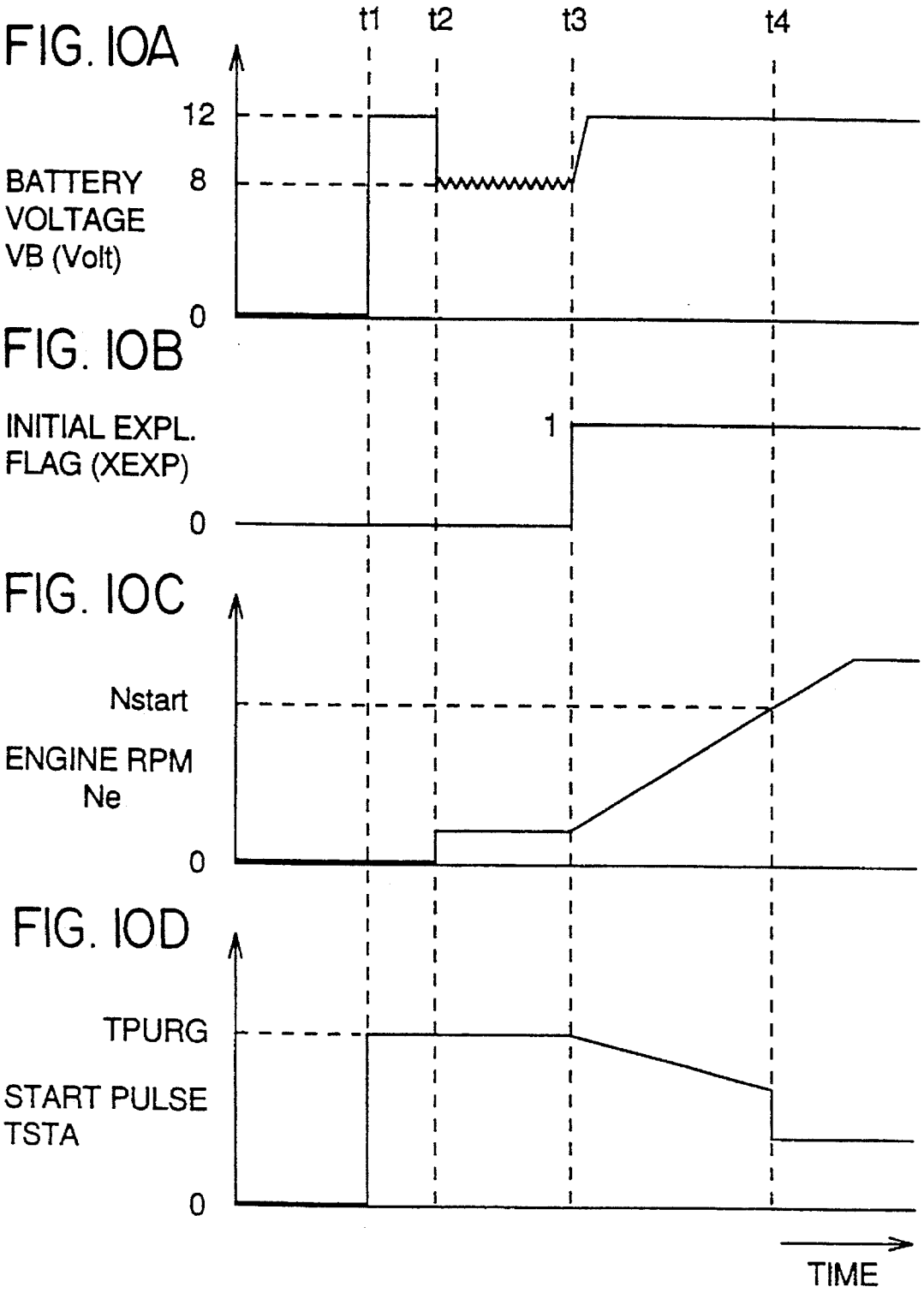
FIGS. 10A to 10D are time charts for explaining the flow charts in FIGS. 7, 8 and 9.
Figure 11:
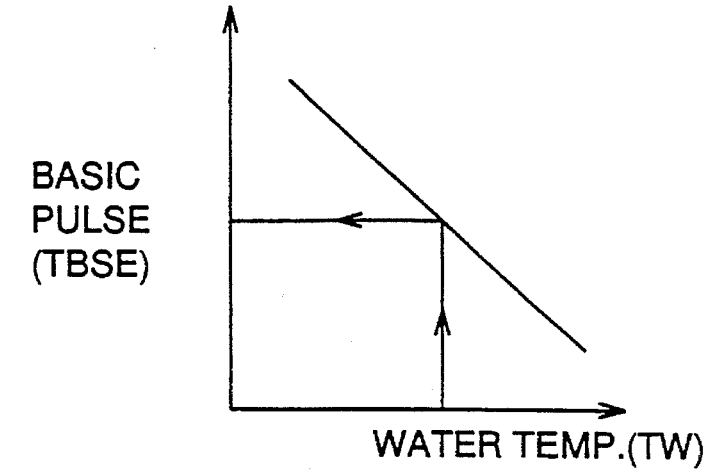
FIG. 11 is a graph showing a relationship between water temperature and a basic pulse.
Figure 12:
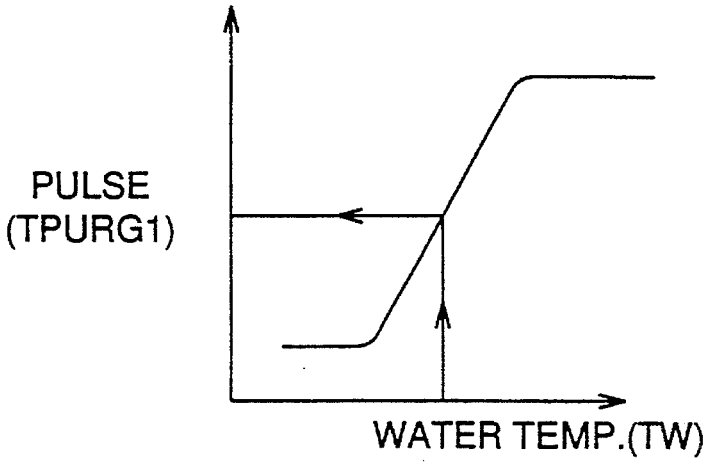
FIG. 12 is a graph showing a relationship between water temperature when an engine is operated under a high temperature condition and a pulse.
Figure 13:
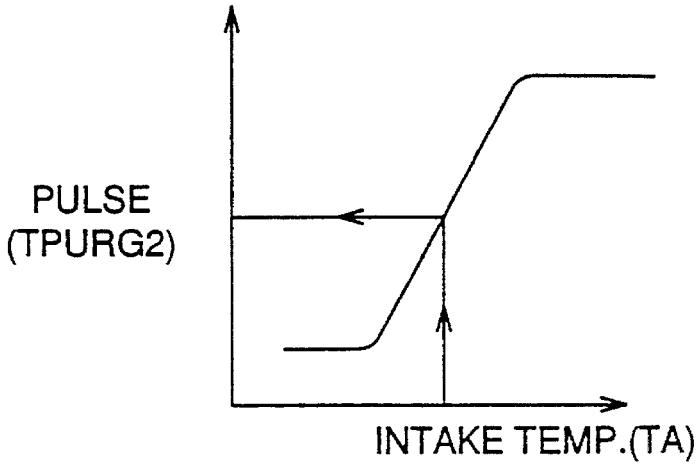
FIG. 13 is a graph showing a relationship between intake air temperature when an engine is operated under a high temperature condition and a pulse.

At the timing t1 in FIGS. 10A to 10D, the key switch 30 is turned to the "ON∞ position, and electric power is supplied to ECU 12 from the battery 31. At this time, as shown in FIG. 10A, a rated battery voltage (12 V in this embodiment) is supplied to the ECU 12 which turns on the initial routine shown in FIG. 7.

Figure 7:
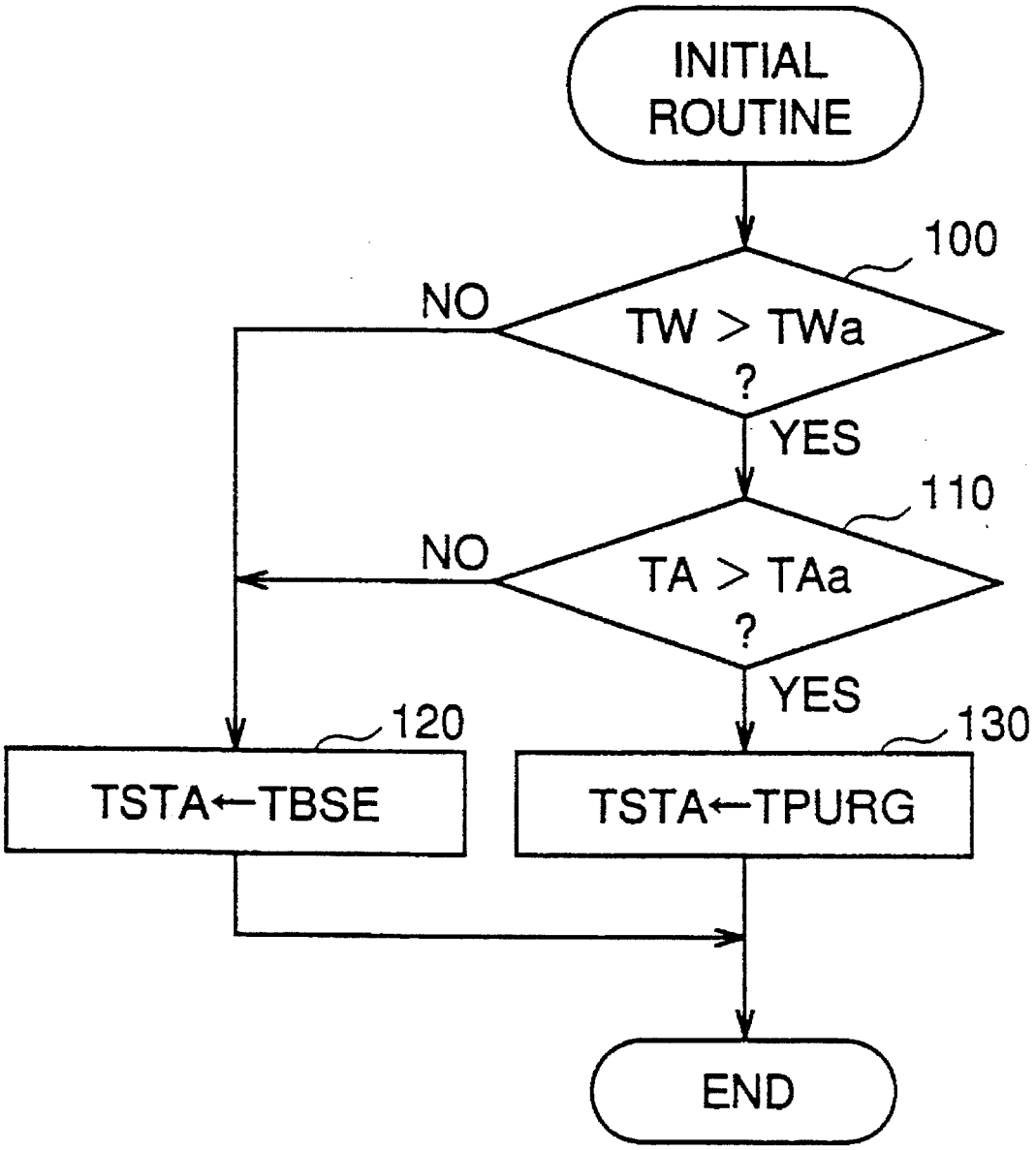
FIG. 7 is a flow chart showing an initial routine performed by an ECU shown in FIG. 6.

As the initial routine starts, ECU 12 judges whether the engine E is under high temperature condition or not in steps 100 and 110 shown in FIG. 7. That is, the ECU 12 judges whether the water temperature TW detected by the water temperature sensor 32 is higher than a predetermined water temperature TWa in the step 100. It also judges whether the intake air temperature TA detected by the intake air temperature sensor 25 is higher than a predetermined intake air temperature TAa in the step 110.

If either one of the steps 100 or 110 in FIG. 7 is not affirmative, the ECU 12 judges that the engine E is not under a high temperature condition and then moves to a next step 120. In the step 120, the ECU 12 calculates a starting pulse TSTA not modified by a high temperature condition, i.e. a basic pulse TBSE and the basic pulse TBSE is memorized in the memory 12*a* as TSTA. The basic pulse TBSE is the value calculated according to the water temperature TW at a given time, using, for example, the map shown in FIG. 11 in which the basic pulse TBSE is set lower as the water temperature TW becomes higher. The ECU 12 finishes the initial routine when the TSTA has been calculated.

When both of the steps 100 and 110 in FIG. 7 are affirmative (TW>TWa, TA>TAa), the ECU judges that the engine E is under a high temperature condition and moves to a next step 130. In the step 130 the ECU calculates the starting pulse TSTA modified by the high temperature condition, i.e. a high temperature pulse TPURG and memorizes the TPURG in the memory 12*a* as the TSTA. The high temperature pulse TPURG is calculated according to the water temperature TW and the intake air temperature TA at that time, using, for example, maps shown in FIGS. 12 and 13. That is, TPURG1 and TPURG2 are determined according to the water temperature TW and the intake air temperature TA, respectively, and the added value thereof makes TPURG (TPURG=TPURG1+TPURG2). Therefore, the higher the water and intake air temperature become, the longer the high temperature pulse TPURG. After the starting pulse has been calculated at the step 130, the ECU 12 finishes the initial routine. Thus, when the engine is restarted under the high temperature condition, the high temperature pulse TPURG is set as TSTA at the timing t1.

At the timing t2 shown in FIGS. 10A to 10D, the key switch 30 is turned to the "START" position and the starter motor 39 begins to run. While the starter motor 39 is cranking the engine E, the rotational speed Ne of the engine E is kept at the same speed as that of the starter motor 39 (100 through 200 rpm). At the same time the battery voltage VB drops due to operation of the starter motor 39 (about 8 volts). At the timing t2 the start injection routine shown in FIG. 8 is also started. The ECU 12 judges whether an initial explosion flag XEXP is 1 or 0 at a step 200 shown in FIG. 8. The initial explosion flag XEXP is determined by the initial explosion flag setting routine shown in FIG. 9 which will be explained in the following.

In FIG. 9, the ECU 12 calculates a battery voltage variation Δ VB from the battery voltage VBi−1 at the time of previous calculation and VBi at this time (ΔVB=VBi−VBi−1). Then the ECU 12 judges whether the voltage variation ΔVB is larger than a predetermined value Va or not at a step 310. During the period from t2 to t3 shown in FIGS. 10A to 10D, the battery voltage VB is kept approximately constant (about 8 volts) because of cranking the engine by the starter motor 39. The battery voltage variation Δ VB, therefore, is smaller than the predetermined value Va, causing the ECU 12 move from the step 310 to the step 320 where the initial explosion flag XEXP is set to "0".

At a timing t3 shown in FIGS. 10A to 10D, the engine E generates torque due to the initial explosion, and the battery voltage VB rises up rapidly because the load of the starter motor 39 becomes lighter rapidly. This makes the battery voltage variation ΔVB larger than the predetermined value Va. As the ECU 12 detects this, it judges that the initial explosion occurred and moves to a next step 330 from the step 310, turning the initial explosion flag to "0". At this timing t3, the engine speed Ne also rises up according to the initial explosion.

Thus, the initial explosion flag XEXP is kept as "0" until the timing t3 shown in FIG. 10A to 10D and thereafter it is set as "1". Therefore, the ECU 12 always goes to a step 210 from the step 200 shown in FIG. 8 during the period from t2 and t3. The ECU 12 outputs at the step 210 the same TSTA pulse (the basic pulse TBSE or the high temperature pulse TPURG) as was memorized in the memory 12*a* in the initial routine shown in FIG. 7 to the injectors 2. Because the high temperature pulse TPURG is set substantially larger than the basic pulse TBSE, the fuel vapor generated in the injectors 2 and the fuel delivery pipe 1 when the engine is operated under high temperature condition can be exhausted through the injectors 2 driven by the high temperature pulse TPURG.

After the ECU 12 outputs the starting pulse TSTA, it moves from the step 210 to 260 shown in FIG. 8. At the step 260, the ECU 12 determines whether the present engine speed Ne is higher than the start judgment speed Nstart. The start judgment speed Nstart is a predetermined value for judging engine start. The fact that the engine speed Ne reached the engine start judgment speed Nstart indicates that the engine E reached the normal operation. During the cranking period between t2 and t3, the step 260 becomes negative so that the ECU operation returns to the step 200. Therefore, the ECU 12 repeats the steps 200, 210 and 260 until the timing t3 comes i.e. until the initial explosion takes place.

As the initial explosion flag XEXP turns to "1" at the timing t3 shown in FIGS. 10A to 10D, the ECU 12 judges that the fuel vapor in the injectors 2 and the fuel delivery pipe 1 has been purged and moves from the step 200 to the step 220 shown in FIG. 8. At the step 220, the ECU 12 subtracts a predetermined value A from the starting pulse TSTA which has been memorized in the memory 12*a* in the initial routine shown in FIG. 7. Then, the ECU 12 moves from the step 220 to the step 230 where it judges whether the starting pulse TSTA calculated at the step 220 is larger than the basic pulse TBSE or not. If the starting pulse TSTA is larger than the basic pulse, the ECU 12 moves to the step 250 where it outputs the starting pulse TSTA to the injectors 2. If the starting pulse TSTA is smaller than the basic pulse TBSE at the step 230, the ECU 12 moves to the step 240 where it uses the basic pulse TBSE as the starting pulse TSTA. In other words, the ECU 12, through the operation at the steps 230 and 240, forbids the starting pulse TSTA from becoming smaller than the basic pulse TBSE.

At a step 260, the ECU 12 determines whether the present engine speed Ne is larger than the start judgment speed Nstart. During the period between the timing t3 and t4 shown in FIGS. 10A to 10D, the step 260 is not affirmative (Ne<Nstart), making the ECU 12 return to the step 200. The ECU 12 repeats the steps 200, 220, 230, 250 and 260 until the timing t4 comes, i.e. until the engine speed Ne becomes higher than the start judgment speed Nstart. During this operation the starting pulse TSTA is decreased gradually by the step 220.

At a timing t4 shown in FIGS. 10A to 10D, the step 260 becomes affirmative (Ne>Nstart). At this time the ECU 12 judges that the engine rotation is stabilized and terminates the operation of the start injection routine. Hereafter, the ECU 12 moves to an afterstart routine which is not shown in the drawing and continues a normal injection control.

According to this invention, the conventional return piping can be eliminated in the fuel supply system. The fuel vapor generated by engine operation at high temperature can be effectively purged through the injectors 2 without having the return piping as described above. As opposed to the conventional fuel injection control system which uniformly sets the timing for increasing injection fuel amount, the fuel supply system according to this invention avoids excessive increase of fuel amount to be injected and attains proper control of the fuel supply. Thus, problemssuch that air-fuel ratio becomes over-rich or spark plugs get wet by fuel can be solved. Moreover, the engine E can be easily restarted under high temperature condition.

Figure 14:
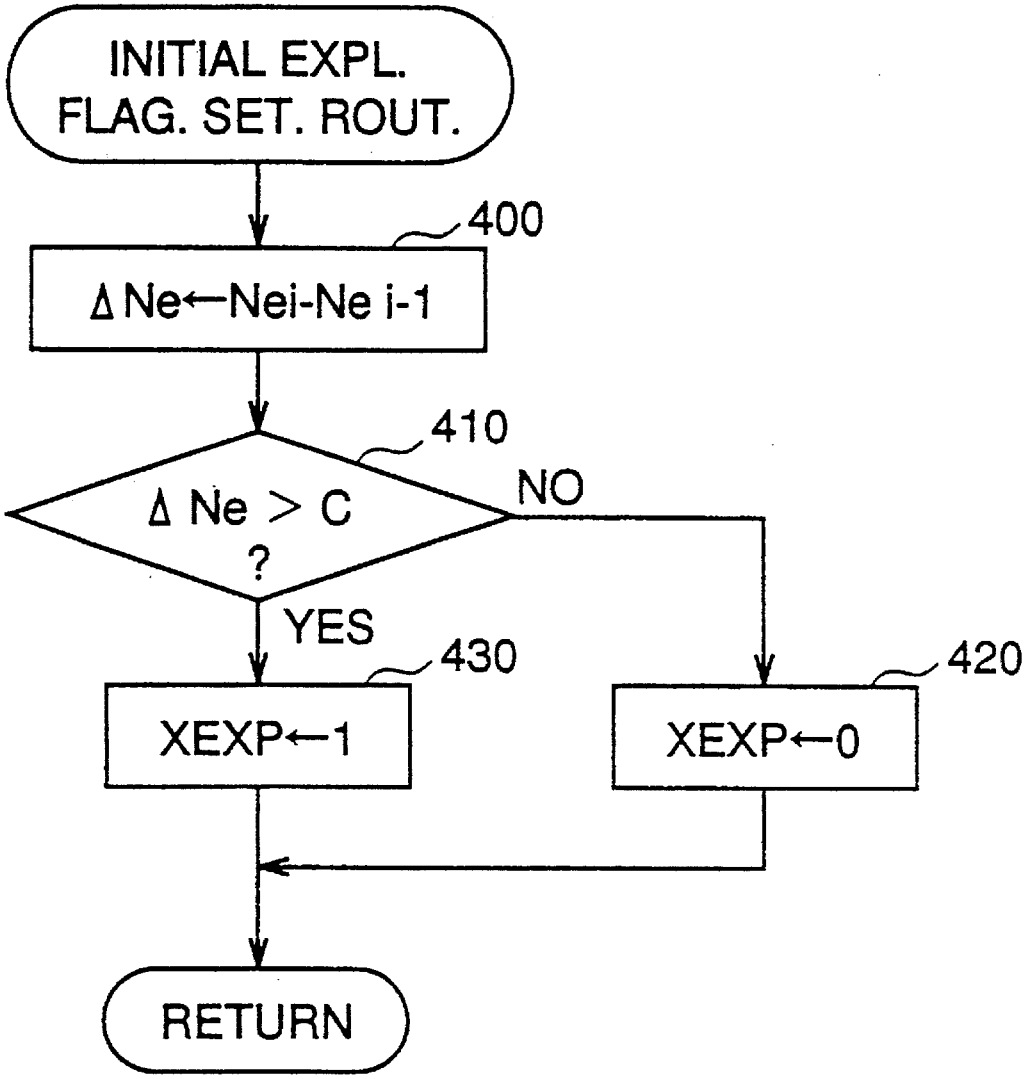
FIG. 14 is a flow chart showing another example of the initial explosion flag setting routine.

It is to be noted that the initial explosion flag setting routine shown in FIG. 9 can be substituted by a routine shown in FIG. 14. In FIG. 14, the ECU 12 calculates at a step 400 the engine speed variation ΔNefrom the engine speed Nei−1 at the previous operation and the engine speed Nei at this time (ΔNe=Nei−Nei−1). During the period between t2 and t3, wherein the engine is being cranked, the engine speed variation ΔNe is smaller than the predetermined value C. Accordingly, the ECU performs consecutively the steps 400, 410 and 420, and at the step 420 it sets the initial explosion flag as "0".

At the timing t3 shown in FIG. 10, the engine speed Ne begins to increase and the variation of the engine speed ΔNe exceeds the predetermined value C. Then, the steps of the ECU 12 move from 400 to 410 and from 410 to 430, and at the step 430 the initial explosion flag is set to "1". Thus, in the routine shown in FIG. 14, the engine speed variation ΔNe is used as a parameter to determine the initial explosion.

The present invention is not limited to the embodiments above-mentioned, but some other variations will be possible. For example, the high temperature pulse TPURG can be switched to the basic pulse TBASE immediately after detection of the initial explosion, i.e. at the timing t3 in FIGS. 10A to 10D, as opposed to the process wherein the high temperature pulse TPURG is gradually decreased to the level of the basic pulse TBSE as explained above. It is also possible to increase gradually the high temperature pulse after start, i.e. at the timing t1, as opposed to the process wherein the high temperature pulse is used immediately after detection of start at the timing t1.

Applying the above-mentioned embodiments to the fuel injection control system shown in FIG. 6, the vapor gas can be effectively exhausted from the injectors and the engine can be easily restarted even at a high temperature by properly increasing the amount of fuel to be injected.

What is claimed is:

1. A fuel supply system for supplying fuel from a fuel tank to an engine through fuel injectors comprising:

a fuel connecting pipe for supplying fuel from said fuel tank;

a delivery pipe connected to said fuel pipe and having a closed end at a most downstream portion of fuel flow for storing therein fuel supplied from said fuel connecting pipe; and a plurality of connectors provided in said delivery pipe for supplying therethrough said stored fuel to said injectors, respectively, wherein at least a first one of said plurality of connectors is arranged to extend upwardly through said delivery pipe to open at an upper portion in said delivery pipe and at least a second one of said plurality of connectors are arranged to extend upwardly to open at a lower portion in said delivery pipe.

2. A fuel supply system according to claim 1, wherein:

said at least said first one of said plurality of connectors is formed with a small passage smaller in inner diameter than a suction port of said injector connected to said at least said first one of said plurality of connectors and extending from said lower portion to said upper portion within said delivery pipe; and said suction port of said injector connected to said at least said first one of said plurality of connectors communicates with said upper portion of said delivery pipe through said small passage.

3. A fuel supply system according to claim 2, wherein said at least said first one of said plurality of connectors has an extension pipe having an outer diameter smaller than that of said suction port of said injector and forming therein said small passage.

4. A fuel supply system according to claim 3, wherein said plurality of connectors are arranged at positions slightly shifted circumferentially upwardly from a lowermost portion of said delivery pipe, said injectors being connected to said lower portion of said delivery pipe in a slanted relationship to a vertical line, and said extension pipe being arranged in a slanted relationship to extend from said suction port of said injector toward an uppermost portion of said delivery pipe.

5. A fuel supply system according to claim 4, wherein said extension pipe has a slanted top end so that said small passage opens horizontally at said uppermost portion in said delivery pipe.

6. A fuel supply system according to claim 1, wherein said at least said first one of said plurality of connectors has a restricted passage extending from said lower portion to said upper portion of said delivery pipe and has a cross-sectional passage area smaller than that of said suction port of said injector so that said suction port of said injector communicates with said upper portion of said delivery pipe.

7. A fuel supply for supplying fuel from a fuel tank to an engine through fuel injectors comprising:

a fuel connecting pipe for supplying fuel from said fuel tank;

a delivery pipe connected to said fuel pipe and having a closed end at a most downstream portion of fuel flow for storing therein fuel supplied from said fuel connecting pipe; and a plurality of connectors provided in said delivery pipe for supplying therethrough said stored fuel to said injectors, respectively, wherein at least one of said plurality of connectors has a small passage which extends from a lower portion to an upper portion of said delivery pipe and has a passage diameter smaller than that of a suction port of said injector connected to said at least one of said plurality of connectors so that said suction port communicates with said upper portion of said delivery pipe through said small passage.

8. A fuel supply system according to claim 7, wherein said at least one of said plurality of connectors has an extension pipe having an outer diameter smaller than that of said suction port of said injector and is formed with said small passage therein.

9. A fuel supply system according to claim 8, wherein:

said plurality of connectors are arranged at positions slightly shifted circumferentially upwardly from a lowermost portion of said delivery pipe;

said injectors are connected to said lower portion of said delivery pipe in a slanted relationship to a vertical line; and said extension pipe is arranged in a slanted relationship to extend from suction ports of said injectors toward an uppermost portion of said delivery pipe.

10. A fuel supply system according to claim 9, wherein said extension pipe has a slanted top end so that said small passage opens horizontally at said uppermost portion in said delivery pipe.

11. A fuel supply system for supplying fuel from a fuel tank to an engine through fuel injectors comprising:

a fuel connecting pipe for supplying fuel from said fuel tank;

a delivery pipe connected to said fuel connecting pipe and having a closed end at a most downstream portion of fuel flow for storing therein fuel supplied from said fuel connecting pipe;

a plurality of connectors provided in said delivery pipe for supplying therethrough said stored fuel to said injectors, respectively;

a fuel pipe mounted parallelly above said delivery pipe and branched off from said fuel connecting pipe for receiving therein at least one of air and vapor in said fuel before it is supplied to said delivery pipe; and a connecting orifice connecting said delivery pipe to said fuel pipe at a position close to said closed end.

12. A fuel supply system for supplying fuel from a fuel tank to an engine through fuel injectors comprising:

a fuel connecting pipe for supplying fuel from said fuel tank;

a delivery pipe connected to said fuel pipe and having a closed end at a most downstream portion of fuel flow for storing therein fuel supplied from said fuel connecting pipe;

a plurality of connectors provided in said delivery pipe for supplying therethrough said stored fuel to said injectors, respectively;

air separation means for separating air from fuel flowing through said fuel connecting pipe upstream of said delivery pipe and storing separated air therein; and air introduction means for introducing said stored separated air exclusively to only some of said injectors.

* * * * *

UNITED STATES PATENT AND TRADEMARK OFFICE

CERTIFICATE OF CORRECTION

PATENT NO. : 5,471,962

DATED : December 5, 1995

INVENTOR(S) : NAKASHIMA et al.

It is certified that error appears in the above-indentified patent and that said Letters Patent is hereby corrected as shown below:

On the title page:

In Item named "Notice:", delete the wording "The portion of the term of this patent subsequent to Nov. 1, 2011, has been disclaimed." and insert --The term of this patent shall not extend beyond the expiration dated of Patent No. 5,359,976.--.

Signed and Sealed this

Twenty-second Day of April, 1997

Bruce Lehman

*Attest:*

BRUCE LEHMAN

*Commissioner of Patents and Trademarks*

*Attesting Officer*